US010113841B2

(12) United States Patent
Foley

(10) Patent No.: US 10,113,841 B2
(45) Date of Patent: Oct. 30, 2018

(54) MODULAR SHOOTING TARGET

(71) Applicant: INTERACTIVE TACTICAL TRAINING SYSTEMS LTD., Kanata (CA)

(72) Inventor: Daniel Shaun Foley, Kanata (CA)

(73) Assignee: INTERACTIVE TACTICAL TRAINING SYSTEMS LTD., Kanata, Ontario (CA)

( * ) Notice: Subject to any disclaimer, the term of this patent is extended or adjusted under 35 U.S.C. 154(b) by 0 days.

(21) Appl. No.: 15/678,047

(22) Filed: Aug. 15, 2017

(65) Prior Publication Data

US 2018/0051965 A1 Feb. 22, 2018

(30) Foreign Application Priority Data

Aug. 19, 2016 (CA) ..... 2939433

(51) Int. Cl.
*F41J 5/18* (2006.01)
*F41J 7/04* (2006.01)
*F41J 5/24* (2006.01)

(52) U.S. Cl.
CPC .. *F41J 7/04* (2013.01); *F41J 5/18* (2013.01); *F41J 5/24* (2013.01)

(58) Field of Classification Search
CPC .. F41J 5/18; F41J 5/20; F41J 7/04; F41J 5/26
USPC ..... 273/380, 382, 383, 386, 393
See application file for complete search history.

(56) References Cited

U.S. PATENT DOCUMENTS 162,149 A * 4/1875 Buckner ..... A63F 9/0204 273/382
683,503 A * 10/1901 Schloerb ..... F41J 5/18 23/302 R
1,266,494 A * 5/1918 Lakin ..... F41J 5/18 273/381
1,277,702 A * 9/1918 Des Combes ..... F41J 5/26 273/380
1,327,998 A * 1/1920 Henigman ..... F41J 5/18 273/383
1,341,814 A * 6/1920 Mosby ..... F41J 5/18 273/383
1,723,826 A * 8/1929 Van Auken ..... F41J 5/18 273/380
1,832,711 A * 11/1931 Jeckert ..... A63F 9/0204 273/374
2,567,557 A * 9/1951 Fedrowich ..... F41J 1/00 273/380
2,613,080 A * 10/1952 Dow ..... A63H 13/02 273/374
2,747,874 A * 5/1956 Cappella, Jr. ..... A63H 23/12 124/37

(Continued)

*Primary Examiner* — Mark Graham
(74) *Attorney, Agent, or Firm* — Loza & Loza, LLP; Heidi Eisenhut

(57) ABSTRACT

In at least one embodiment the present invention can provide a modular shooting target for shooting practice having a first target component and a second target component, a trigger release element positioned adjacent to one of the first target component and the second target component and a connector element having a first end and a second end, the first end engaged with the trigger release element and the second end fixed to a secondary attachment point.

6 Claims, 4 Drawing Sheets

(56) References Cited

U.S. PATENT DOCUMENTS

| | | | | | |
|---|---|---|---|---|---|
| 4,090,714 | A * | 5/1978 | Izushi | F41J 5/02 | 463/52 |
| 4,145,049 | A * | 3/1979 | Papazian, Sr. | A63F 9/0247 | 273/351 |
| 5,183,427 | A * | 2/1993 | Draper | A63F 9/0073 | 273/383 |
| 5,222,741 | A * | 6/1993 | Redl | F41J 7/04 | 273/393 |
| 5,334,073 | A * | 8/1994 | Tilbor | A63H 3/16 | 273/380 |
| 5,647,596 | A * | 7/1997 | Rail | F41J 5/18 | 273/374 |
| 5,690,338 | A * | 11/1997 | Cain | F41J 5/22 | 273/380 |
| 7,712,743 | B1 * | 5/2010 | Miller | F41J 1/01 | 273/380 |
| 2013/0147117 | A1 * | 6/2013 | Graham | F41J 7/04 | 273/393 |
| 2015/0069706 | A1 * | 3/2015 | Fodera | F41J 1/10 | 273/380 |

* cited by examiner

MODULAR SHOOTING TARGET

FIELD

The present invention relates to shooting training. More specifically, the present invention relates to a modular shooting target that can be used in shooting training, including but not limited to both archery and firearm shooting.

BACKGROUND

Target practice is a common training exercise for archers and marksmen. Specifically, it is well known that firearm users regularly practice their shooting skills for a variety of self-defense, hunting, professional, competitive or recreational reasons. Similarly, archers often engage in target practice to sharpen their bow skills.

Accordingly, a wide variety of temporary, reusable or replaceable targets have been developed as it will be readily understood that a target will necessarily be destroyed by repeated and successful target practice involving firearms or other projectile firing weapons (for example, cross bows, compound bows and long bows). Therefore, any suitable practice target must, at an absolute minimum, be relatively cost-effective to manufacture.

For example, simple paper targets cost very little to manufacture and are quite easy to replace. However, such targets are 2-dimensional, offer very little illusion of reality and do not permit the incorporation of other training exercises (such as non-target practice related activities such as hand-to-hand combat or perpetrator restraint) that could be employed with a more realistic, 3-dimensional target.

Moreover, known three-dimensional targets are not necessarily responsive or readily collapsible in that such known targets do not readily replicate the experience of successfully executing an ultimately disabling (i.e. a "kill") shot. In other words, with traditional three-dimensional foam targets, a target shot that hits an extremity of the target is not clearly distinguishable from a target that hits a central area of the target despite the fact that, as will be readily understood by the skilled person, in practical reality the latter type of shots typically are far more effective than the former type of shots.

Accordingly, there is need for an economical, easy to manufacture and assemble, modular, collapsible, responsive and realistic target for use in a wide variety of target training activities.

BRIEF SUMMARY

It is contemplated that the present invention can provide an economical, easy-to-manufacture and assemble, modular, collapsible, responsive and realistic target for use in a wide variety of target training activities.

In at least one embodiment, a modular shooting target for shooting practice is provided having at least a first target component and a second target component, at least one trigger release element, the at least one trigger release element positioned adjacent to at least one of the first target component and the second target component; and at least one connector element having a first end and a second end, the first end engaging with the at least one trigger release element and the second end fixed to a secondary attachment point.

DESCRIPTION OF THE DRAWINGS

The present invention will be better understood in connection with the following drawings, in which.

DETAILED DESCRIPTION OF THE EMBODIMENTS

Figure 1:
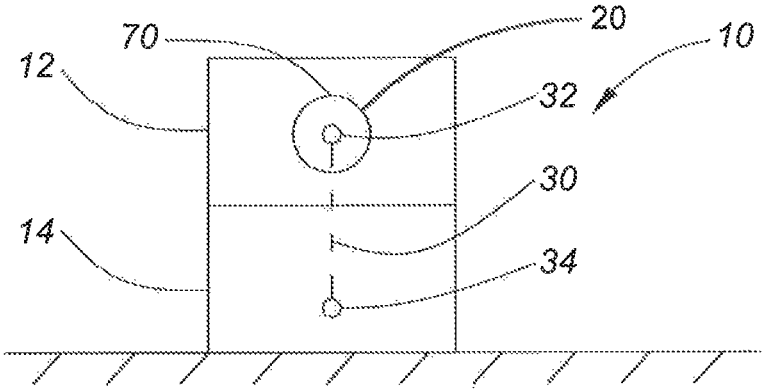
FIG. 1 is an illustration of a modular shooting target in accordance with one embodiment of the present invention.

The present invention can provide a modular shooting target for shooting practice that is comprised of a plurality of target components. As will be discussed at length below, the overall shape of the target and moreover, the constituent target components can be completely varied, depending on the particular application of the invention. It is contemplated that the target can be ultimately comprised of two or many more target components suitable joined together.

Further, it is contemplated that the target components can be formed of any suitable material, in any suitable shape and by any suitable process as required by the particular embodiment. In at least one embodiment, it is contemplated that the target components are made of expanded foam, cardboard, or hardened plastic.

It is contemplated that when assembled, the plurality of target components can result in a target that can take any number of forms, including but not limited to, a game animal, a partial or full humanoid form, a geometric shape and a bullseye, among any other suitable shape that will be readily understood by the skilled person.

Moreover, the individual target components can include any ornamental feature to result in any suitable overall aesthetic. For example, it is contemplated that any target component disclosed herein can be fashioned to look like a human limb (perhaps with a joint), an animal's head or a component of a vehicle, among any other suitable shape as required by the particular application of the present invention.

In at least one embodiment, it is contemplated that the target component can have a generally centrally located cavity that can receive a trigger release element. In some embodiments, the trigger release element will be received snugly within the cavity, (or even by way of a force fit); whereas in other embodiments it is contemplated that the trigger release element is received loosely in the cavity; whereas in other embodiments it is contemplated that trigger release element further comprises a secondary holding system that acts like a releasing trigger as discussed below, among other arrangements that will be readily appreciated by the skilled person. In some embodiments, it is contemplated that the trigger release element is located adjacent to but not within the target component, among other arrangements that will be readily appreciated by the skilled person.

In at least one embodiment, it is contemplated that the cavity has an opening through an outer surface of the target component that communicates with the environment so that the trigger release element can be seen from afar or that is covered so that the trigger release element cannot be seen. Moreover, it is contemplated that the target component may have internal channels that communicate from one surface of the target component to another surface of the target component (or, alternatively in some embodiments from the cavity of the target component to an outer surface of the target component) in order to accommodate a connector, as will be discussed in further detail below.

In at least one embodiment, it is contemplated that the trigger release element is a frangible hub element that is a flat, circular disk-shaped element constructed of a suitably fragile material, however other frangible hub element shapes are readily contemplated including square, hexagonal, prismatic among any other suitable shape that will be readily understood by the skilled person.

In other embodiments, it is contemplated that the trigger release element is a trigger release plate that is a flat, circular disk-shaped element constructed of a suitably robust material, however other robust hub element shapes are readily contemplated including square, hexagonal, prismatic among any other suitable shape that will be readily understood by the skilled person. In these embodiments, it is further contemplated that the trigger release plate is releasable received in a sling element that that is connected to one end of a connector element as will be discussed in further detail below. In at least one embodiment it is contemplated that the sling element will be constructed of a suitable flexible material, such as but not limited to nylon webbing, among other suitably flexibly yet robust materials that will be readily appreciated by the skilled person.

While it is contemplated that the present invention comprises at least one trigger release element, it will be readily appreciated that in some embodiments multiple trigger release element will be present. For example, it is contemplated that in some embodiments each target component can have an associated trigger release element, among other arrangements that will be readily understood by the skilled person and as will be discussed in further detail below.

The present invention further has at least one connector having a first end connected to the trigger release element and a second end connected to a secondary attachment point. It is contemplated that the at least one connector could be stiff or flexible and inelastic or elastic as required by the particular application of the present invention. In at least one embodiment it is contemplated that the connector is flexible yet inelastic and can be formed of any suitable material including but not limited to, parachute cord, as will be readily understood by the skilled person.

It is contemplated that the first end of the connector can be either fixedly or removeably connected to the trigger release element as required by the particular application of the present invention. In some embodiments it is contemplated that the connector can have a first end that removeably cooperates with a corresponding receiving element on the trigger release element, such as the sling element discussed above, among other arrangements that will be contemplated by the present invention.

It is contemplated that the second end of the connector is connected to a secondary attachment point. As will be discussed in further detail below, it is contemplated that the secondary attachment point could be located on an overhead mounting surface, within an adjacent or removed target component or in an adjacent target release element, among any other suitable arrangements that will be readily understood by the skilled person.

Moreover, it is contemplated that, for example, the second end of the connector is fixedly attached to the overhead mounting surface, permanently anchored within the particular target component or, alternatively, removably connected to an adjacent target release, among any other suitable arrangements depending on the particular requirements of the embodiments employed.

In this way, it is contemplated that the at least one connector can hold the at least two target elements together under at least the force of tension when the trigger release element is in place and connected to the first end of the connector in order to form the resultant target.

When the trigger release element is a frangible hub element and a practice shooter successfully targets the frangible hub element with a practice shot, it is contemplated that the frangible hub element will thereby shatter, causing the at least one connector to be released from the frangible hub element (subsequently releasing tension) and thereby releasing the first target component from the second target component; or whereas the subsequent release of tension will cause slack between the connector of the first target component and the second target component. In this way a direct hit (i.e. a shot that strikes and fragments the frangible hub element) is rewarded with the collapse of the target.

When the trigger release element is a trigger release plate that is received in a sleeve element and a practice shooter successfully targets the trigger release plate with a practice shot, it is contemplated that the trigger release plate will be dislodged from the sleeve element thereby causing the at least one connector to be released from the trigger release plate (subsequently releasing tension) and thereby releasing the first target component from the second target component as the subsequent release of tension will cause slack between the connector of the first target component and the second target component. In this way a direct hit (i.e. a shot that dislodges the trigger release plate from the sleeve element) is rewarded with the collapse of the target.

Subsequently, the target can be reloaded by resetting the trigger release element (either by replacing the frangible hub element or repositioning the trigger release plate within the sleeve element) and reconnecting at least the first component to the second component, thereby reforming the completed target for further target practice.

Turning to FIG. 1, one embodiment of a modular shooting target in accordance with the present invention is illustrated. In this embodiment, target 10 has at least a first target component 12 and a second target component 14. In this embodiment, it is contemplated that the two target components abut one another when target 10 is assembled however other arrangements are contemplated as will be discussed in further detail below.

In this embodiment, the target is freestanding and a trigger release element that is a frangible hub element 20 is located at a central position of first target component 12. Second target component 14 abuts first target component 12 and is otherwise positioned on the ground. At least one connector 30 is provided having a first end 32 connected to frangible hub element 20 and a second end 34 anchored within second target component 14.

In this way, it is contemplated that a direct hit from a bullet or an arrow, airsoft BB, physical strike, or any other suitable force to the frangible hub element 20 will shatter this component thereby releasing at least one connector 30 from tension. Therefore, first target component 12 is no longer secured tightly to second target component 14 and therefore target 10 can topple over, registering a direct hit in an obvious and dramatic fashion.

Figure 2:
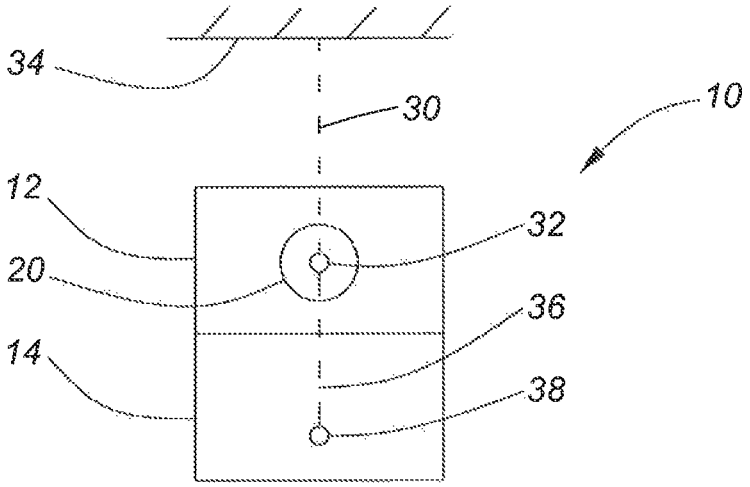
FIG. 2 is an illustration of a modular shooting target in accordance with another embodiment of the present invention.

Turning to FIG. 2, another embodiment of a modular shooting target in accordance with the present invention is illustrated. In this embodiment, target 10 is hung from an overhead mounting surface. Further, target 10 has at least the first target component 12 and the second target component 14. In this embodiment, it is contemplated that the two target components abut one another when target 10 is assembled however other arrangements are contemplated as will be discussed in further detail below.

In this embodiment, the target is not freestanding and the trigger release element is a frangible hub 20 located at a central position of first target component 12. At least one connector 30 is provided having a first end 32 connected to frangible hub 20 and a second end 34 anchored to the overhead mounting surface. A second at least one connector 36 is further provided having a first end anchored to frangible hub element 20 and a second end 38 anchored within second target component 14.

In this way, it is contemplated that a direct hit from a bullet or an arrow to frangible hub element 20 will shatter this component thereby releasing at least one connector 30 from tension. Therefore, first target component 12 is no longer secured to second target component 14 and therefore target 10 will fall to the ground under the force of gravity, registering a direct hit in an obvious and dramatic fashion.

Figure 3:
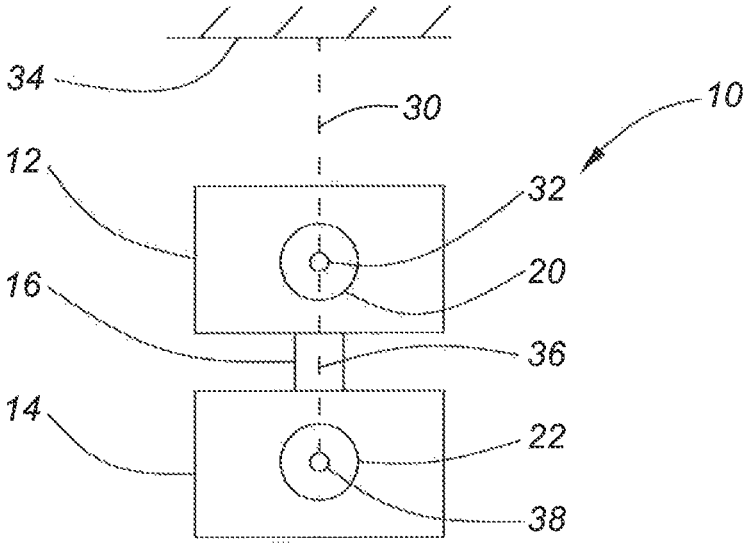
FIG. 3 is an illustration of a modular shooting target in accordance with another embodiment of the present invention.

Turning to FIG. 3, yet another embodiment of a modular shooting target in accordance with the present invention is illustrated. In this embodiment, target 10 is hung from an overhead mounting surface. Further, target 10 has at least the first target component 12, the second target component 14 and an intermediary target component 16. In this embodiment, it is contemplated that the three target components abut one another when target 10 is assembled however other arrangements are contemplated as will be discussed in further detail below.

In this embodiment, the target is not freestanding and the trigger release element is a first frangible hub element 20 located at a central position of first target component 12 and a second frangible hub element 22 located at a central position of second target component 14. At least one connector 30 is provided having a first end 32 connected to first frangible hub element 20 and a second end 34 anchored to the overhead mounting surface. A second at least one connector 36 is further provided having a first end anchored to frangible hub element 20, extending through intermediary target component 16 and having second end 38 connected to second frangible hub element 22 provided in second target component 14.

In this way, it is contemplated that a direct hit from a bullet or an arrow to either first frangible hub element 20 or second frangible hub 22 component will shatter this component thereby releasing the first at least one connector 30 or the second at least one connector 36 from tension. Therefore, first target component 12 is no longer secured to second target component 14 or intermediary target component 16 and therefore target 10 will fall to the ground under the force of gravity, registering a direct hit in an obvious and dramatic fashion.

Figure 4:
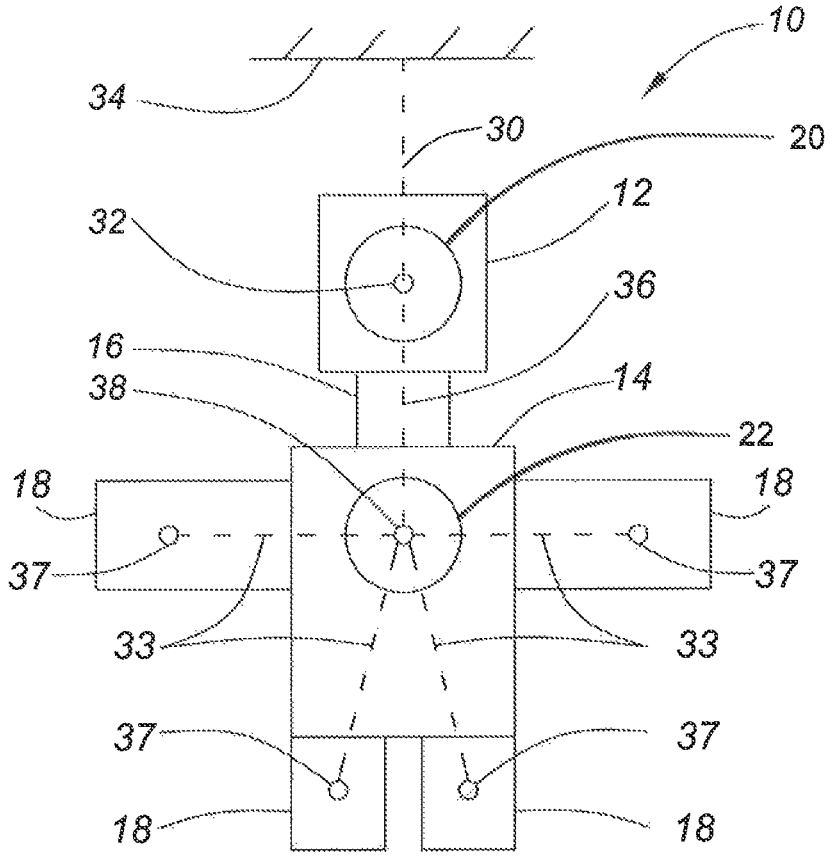
FIG. 4 is an illustration of a modular shooting target in accordance with another embodiment of the present invention.

Turning to FIG. 4, yet another embodiment of a modular shooting target in accordance with the present invention is illustrated. In this embodiment, target 10 is hung from an overhead mounting surface. Further, target 10 has at least the first target component 12, the second target component 14, an intermediary target component 16, and additional target components 18. In this embodiment, it is contemplated that the target components abut one another when target 10 is assembled however other arrangements are contemplated as will be discussed in further detail below.

In this embodiment, the target is not freestanding and the trigger release element is a first frangible hub element 20 located at a central position of first target component 12 and second frangible hub element 22 located at a central position of second target component 14. At least one connector 30 is provided having a first end 32 connected to first frangible hub element 20 and a second end 34 anchored to the overhead mounting surface. A second at least one connector 36 is further provided having a first end anchored to frangible hub element 20, extending through intermediary target component 16 and having second end 38 connected to second frangible hub element 22 provided in second target component 14.

Moreover, a plurality additional at least one connectors 33 each having a first end connected to second frangible hub element 22 and a second end 37 anchored within each respective additional target component 18 is provided in order to provide a more lifelike target 10.

In this way, it is contemplated that a direct hit from a bullet or an arrow to either first frangible hub element 20 or second frangible hub element 22 will shatter this component thereby releasing the first at least one connector 30, the second at least one connector 36, or the additional at least one connectors 33 from tension. Therefore, first target component 12 is no longer secured to second target component 14, intermediary target component 16 or additional target component 18 and therefore target 10 will fall to the ground under the force of gravity, registering a direct hit in an obvious and dramatic fashion.

Figure 5:
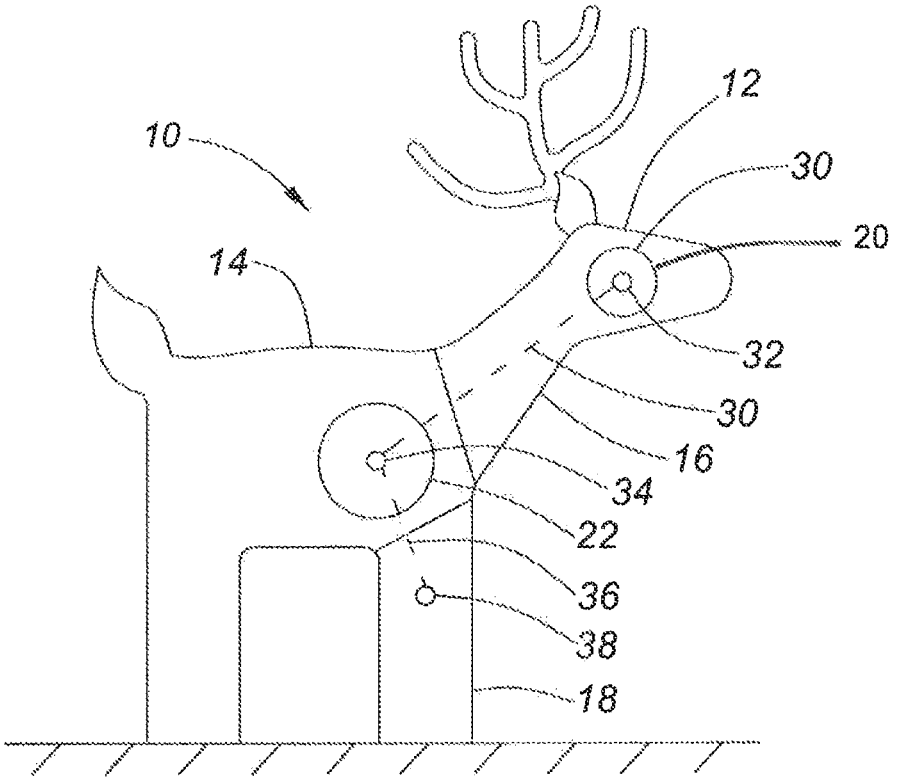
FIG. 5 is an illustration of a modular shooting target in accordance with another embodiment of the present invention.

Turning to FIG. 5, yet another embodiment of a modular shooting target in accordance with the present invention is illustrated. In this embodiment, target 10 is freestanding. Further, target 10 has at least the first target component 12, the second target component 14, an intermediary target component 16 and an additional target component 18. In this embodiment, it is contemplated that the three target components abut one another when the target is assembled however other arrangements are contemplated as will be discussed in further detail below.

In this embodiment, the target is freestanding and the trigger release element is a first frangible hub element 20 located at a central position of first target component 12 and a second frangible hub element 22 located at a central position of second target component 14. At least one connector 30 is provided having a first end 32 connected to first frangible hub element 20 extending through intermediary component 16 and having a second end 34 connected to the second frangible hub element 22. A second at least one connector 36 is further provided having a first end anchored to second frangible hub 22 and having second end 38 anchored within an additional target component 18.

In this way, it is contemplated that a direct hit from a bullet or an arrow to either first frangible hub element 20 or second frangible hub element 22 will shatter this component thereby releasing the first at least one connector 30 or the second at least one connector 36 from tension. Therefore, first target component 12 is no longer secured to second target component 14, intermediary target component 16 or additional target component 18 and therefore target 10 will fall to the ground under the force of gravity, registering a direct hit in an obvious and dramatic fashion.

Figure 6:
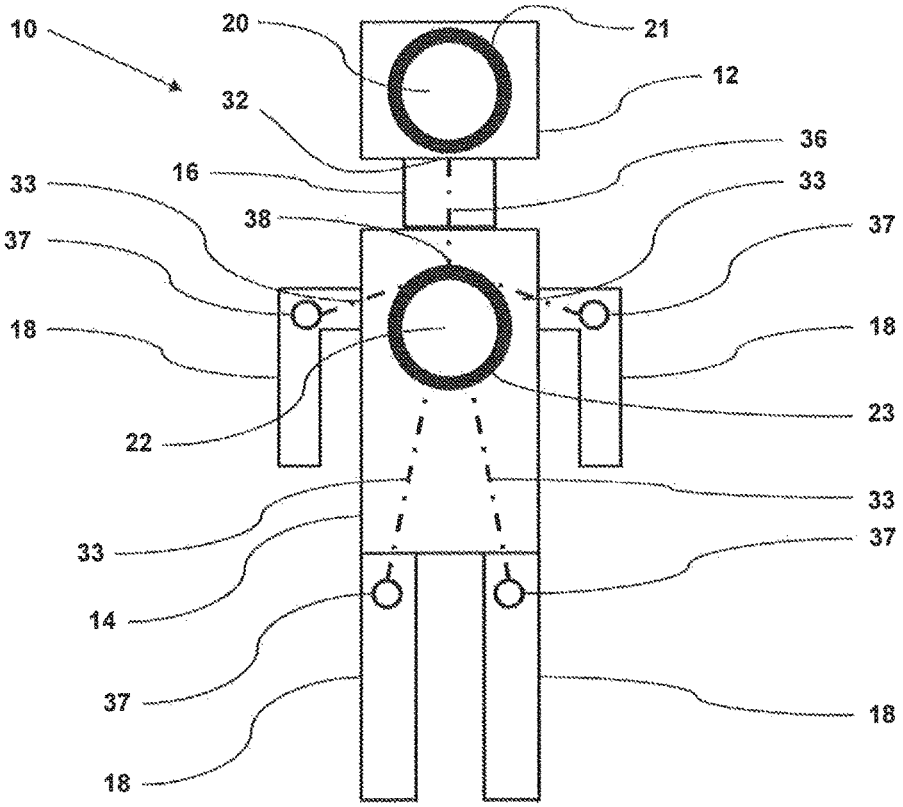
FIG. 6 is an illustration of a modular shooting target in accordance with another embodiment of the present invention.

Turning to FIG. 6, yet another embodiment of a modular shooting target in accordance with the present invention is illustrated. In this embodiment, target 10 is freestanding. Further, target 10 has at least the first target component 12, the second target component 14, an intermediary target component 16, and additional target components 18. In this embodiment, it is contemplated that the target components abut one another under tension when target 10 is assembled however other arrangements are contemplated as will be discussed in further detail below.

In this embodiment, the target is freestanding and the trigger release element is a first trigger release plate 20 received in a first sleeve element 21 and located at a central position of first target component 12 and a second trigger release plate 22 received in a second sleeve element 23 located at a central position of second target component 14. At least one connector 36 is provided having a first end 32 connected to first sleeve element 21 extending through intermediary component 16 and having a second end 38 connected to the second sleeve element 23 provided in second target component 14.

Moreover, a plurality of additional at least one connectors 33 each having a first end connected to second sleeve element 23 and a second end 37 anchored within each respective additional target component 18 is provided in order to provide a more lifelike target 10.

In this way, it is contemplated that a direct hit from a bullet or an arrow to either first trigger release plate 20 or second trigger release plate 22 will dislodge the trigger release plate 20,22 relative to the respective sleeve element 21,23 thereby causing tension to be released throughout all connectors. Therefore, first target component 12 is no longer under tension with second target component 14, intermediary target component 16 or additional target component 18 and therefore target 10 will fall to the ground under the force of gravity by target components becoming loose with one another, registering a direct hit in an obvious and dramatic fashion.

The present disclosure provides for reference to specific examples. It will be understood that the examples are intended to describe embodiments of the invention and are not intended to limit the invention in any way. Moreover, it is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

The embodiments of the invention for which an exclusive property or privilege is claimed are defined as follows:

1. A modular shooting target for shooting practice comprising:

at least a first target component and a second target component;

at least one trigger release element that is a frangible hub element, the at least one frangible hub element positioned within one of the first target component and the second target component; and at least one connector element having a first end and a second end, the first end connected to the at least one frangible hub element in a fixed manner and the second end fixed to a secondary attachment point, the secondary attachment point located on one of the first target component and the second target component, wherein the at least first target component is biased under tension to the at least one second target component by the at least one connector element such that when the at least one frangible hub element is fractured the at least first target component is no longer biased under tension to the at least one second target component thereby collapsing the modular shooting target.

2. The modular shooting target of claim 1 wherein the at least one trigger release element is a trigger release plate received in a receiving sleeve, the receiving sleeve connected to the first end of the at least one connector element.

3. The modular shooting target of claim 1 wherein the at least one trigger release element is a first trigger release element and a second trigger release element and the secondary attachment point is located on the second trigger release element.

4. The modular shooting target of claim 1 further comprising an intermediary target component positioned between the first target component and the second target component, the intermediary target component having a channel for accommodating the at least one connector element.

5. The modular shooting target of claim 1 wherein the at least one trigger release element is connected to the at least one connector element in a removable manner.

6. The modular shooting target of claim 1 wherein at least one of the first target component and the second target component further comprises a central cavity and at least one channel, the central cavity adapted to receive the at least one trigger release element and the at least one channel adapted to receive the at least one connector element, the at least one channel communicating with the trigger release element and at least one outer surface of the at least one of the first target component and the second target component.

* * * * *